US009162345B2

(12) United States Patent
de Reynal

(10) Patent No.: US 9,162,345 B2
(45) Date of Patent: Oct. 20, 2015

(54) DRILLING OR ABRADING TOOL HAVING A WORKING SURFACE WITH AN ARRAY OF BLIND APERTURES PLUGGED WITH SUPER-ABRASIVE MATERIAL

(75) Inventor: Michel de Reynal, Arthez de Bearn (FR)

(73) Assignee: Varel International Ind., L.P., Carrollton, TX (US)

( * ) Notice: Subject to any disclaimer, the term of this patent is extended or adjusted under 35 U.S.C. 154(b) by 492 days.

(21) Appl. No.: 13/491,798

(22) Filed: Jun. 8, 2012

(65) Prior Publication Data

US 2013/0326964 A1 Dec. 12, 2013

(51) Int. Cl.

| | |
|---|---|
| ***E21B 10/43*** | (2006.01) |
| ***B24D 99/00*** | (2010.01) |
| ***E21B 10/00*** | (2006.01) |

(52) U.S. Cl.

CPC ..... *B24D 99/005* (2013.01); *E21B 10/00* (2013.01); *E21B 10/43* (2013.01)

(58) Field of Classification Search

CPC ..... E21B 10/00; E21B 10/46; E21B 10/36; E21B 10/43; B24D 99/005; B24D 3/04

USPC ..... 175/401, 412, 413, 415, 419, 327, 398, 175/394, 377, 420.2, 426, 434, 379, 428, 175/435, 432, 425; 51/309, 307; 451/461, 451/540

See application file for complete search history.

(56) References Cited

U.S. PATENT DOCUMENTS

2012/0005966 A1* 1/2012 Cleboski et al. ..... 51/295
2013/0075167 A1* 3/2013 Knull et al. ..... 175/428

OTHER PUBLICATIONS

"Micro Drilling Using EDM and Advantages Over Other Micro Drilling Technologies 80," by Zycon, found at http://zycon.hubpages.com/hub/Micro-Drilling-Using-EDM-and-Advantages-Over-Other-Micro-Drilling-Technologies (2 pages), Jan. 19, 2011.

Diver, C., et al: "Micro-EDM Drilling of Tapered Holes for Industrial Applications," Journal of Materials Processing Technology 149 (2004) 296-303.

Cusanelli, G., et al: "Properties of Micro-Holes for Nozzle by Micro-EDM," 15th International Symposium on Electromachining (ISEM XV) (5 pages), Jan. 2007.

* cited by examiner

*Primary Examiner* — Yong-Suk (Philip) Ro

(74) *Attorney, Agent, or Firm* — Gardere Wynne Sewell LLP; Andre M. Szuwalski

(57) ABSTRACT

A substrate includes a surface having blind apertures formed therein. The blind apertures formed in the surface are preferably arranged in a regular and repeating pattern, such as with an array. A super-abrasive material fills each of the blind apertures. Each apertures hole has an opening with a cross-sectional dimension in the range of 1 mm to 15 mm. The super-abrasive material filling each of the plurality of blind apertures may be a polycrystalline diamond compact or an impregnated diamond material (such as formed by fused tungsten carbide impregnating randomly distributed diamond particles). The blind apertures may be formed in the substrate using electrical discharge machining.

25 Claims, 4 Drawing Sheets

DRILLING OR ABRADING TOOL HAVING A WORKING SURFACE WITH AN ARRAY OF BLIND APERTURES PLUGGED WITH SUPER-ABRASIVE MATERIAL

BACKGROUND

1. Technical Field

The present invention relates generally to drilling tools, and more particularly to the making of a drilling or abrading tool having a working surface with an array of blind apertures plugged with super-abrasive material.

2. Description of Related Art

Diamond-impregnated drill bits are well known to those skilled in the art. Such bits are conventionally manufactured using a powder metallurgy process wherein abrasive particles are randomly mixed within a matrix powder that is subjected to infiltration with a molten binder material. For example, diamond particles or grit may be mixed with a tungsten carbide powder, with the mixture then infiltrated by a molten copper alloy. Fusing of the tungsten carbide powder to retain the randomly distributed diamonds in alternative implementations may be effectuated by a hot isostatic pressing or sintering process.

The powder metallurgy process for diamond impregnation may be applied in connection with the making of the entire drill bit or parts of the drill bit. Alternatively, the powder metallurgy process for diamond impregnation may be applied in connection with the making of an impregnated construct or segment that is attached to a bit body so as to form the drill bit. Examples of such constructs include cells, blades or inserts affixed to the bit body by, for example, a brazing process.

There exist a number of concerns with respect to the prior art impregnated-diamond process and resulting impregnated-diamond drill bits.

First, the random distribution of grit or small carat weight diamond granules within a cell of tungsten carbide powder does not ensure smooth diamond coverage in the fused diamond-impregnated structure. Indeed, the random distribution necessarily implies an irregular diamond distribution including areas with diamond clusters, areas of lower diamond concentration, and even areas that are void of diamond content. As a result, the behavior of the cuttings across the impregnated working surface of the structure during tool operation is not predictable.

Second, the failure of diamond-impregnated structures has been linked to the presence of the randomly distributed diamond content. Historically, the random distribution of diamond content within the diamond-impregnated structure was viewed as desirable. The reason for this was that fresh cutting diamond was constantly being exposed on the working surface as the tungsten carbide matrix surrounding the diamond particles was worn away during the abrading, grinding, machining, or cutting process for which the structure was being used. However, areas of the structure with diamond clusters may lack sufficient matrix material to support diamond retention during tool operation, while areas of low or no diamond content tend to exhibit poor wear properties. The random diamond distribution further allows for an accompanying random distribution of matrix material striations trailing behind the exposed diamond particles. The striations reduce the ability of cooling fluids to carry heat away from the working surface, and the excess heat build-up at the working surface tends to accelerate diamond failure and wear of the tungsten carbide matrix.

Third, the inability to control diamond content with respect to the random distribution, with the resulting uneven diamond distribution across the working surface, necessitated the inclusion of extra diamond in the mixture so as to prevent occurrence of an uncut portion of the profile and subsequent "ring out." This extra diamond has adverse affects on the tool both economically (in terms of added cost) and mechanically (due to a reduction in stress at the target interface by increasing the footprint in the same proportion, where stress is roughly expressed by the applied weight over the footprint area).

Fourth, if the fusing process utilized high heat, such as would be the case at least with respect to a sintering process, the applied heat could subject the diamond content to a graphitizing temperature for an unacceptable length of time. This would effectively degrade the properties of the impregnated diamond. The diamond-impregnated structure would then experience a reduced working life.

Fifth, the striations trailing behind the exposed diamond particles could produce a clogged interface between the structure and the surface of the target material (such as a rock formation in an earth drilling application). These striations further limit the depth of cut. Overall, this has an adverse affect on rate of penetration of the construct into the work target.

There is a need in the art for an improved drilling tool which addresses the foregoing, and other, problems experienced with the making and use of tools including randomly distributed impregnated diamond structures.

SUMMARY

In an embodiment, an apparatus comprises: a substrate having a surface; a plurality of blind apertures formed in said surface, wherein each aperture in the plurality of blind apertures has an opening with a cross-sectional dimension in the range of 1 mm to 15 mm; and a super-abrasive material filling each of the plurality of blind apertures.

The plurality of blind apertures formed in said surface are preferably arranged in a regular and repeating pattern, such as with an array.

The super-abrasive material filling each of the plurality of blind apertures may comprise a polycrystalline diamond compact or an impregnated diamond material (such as formed by fused tungsten carbide impregnating randomly distributed diamond particles).

BRIEF DESCRIPTION OF THE DRAWINGS

Other features and advantages of the invention will become clear in the description which follows of several non-limiting examples, with reference to the attached drawings wherein.

DETAILED DESCRIPTION OF THE DRAWINGS

Figure 1A:
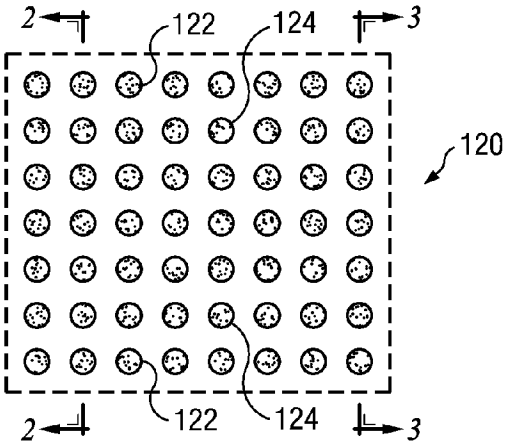
FIG. 1A illustrates a close-up view of a portion of the surface of the drill bit in FIG. 1.
Figure 1:
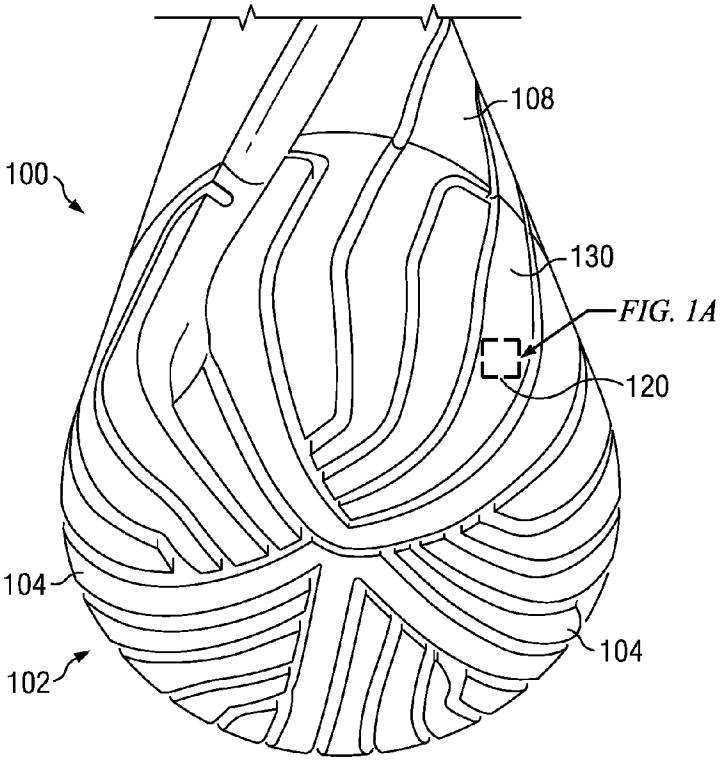
FIG. 1 illustrates a perspective view of a drill bit.

Reference is now made to FIG. 1 which illustrates a perspective view of a drill bit 100. The drill bit 100 includes a crown portion 102 formed of a plurality of blades 104. The blades 104 in general extend from a central region of the crown portion 102 at or near the bit axis of rotation to an outer periphery region of the bit 100 at the bit gage region. The portion of the blades 104 extending at the bit gage region may be referred to as gage pads 108. The blades 104 are separated from each by channels (also referred to as junk slots) that permit the return flow of drilling cuttings and drilling fluid.

In prior art diamond-impregnated bits, the blades 104 would be made, for example, of fused tungsten carbide which impregnates randomly distributed diamond. Alternatively, an impregnated diamond construct (or segment), again made of fused tungsten carbide which impregnates randomly distributed diamond, would be attached the body of the bit at the blade regions.

In FIG. 1, however, the blades 104 (and their gage pad 108 extensions) are made of the same material as is used for the bit body (and are integrally fabricated with the bit body). In many applications, this material is tungsten carbide. In other applications, the material may comprise hardened steel. In still other applications, the material may comprise materials known to those skilled in the art for use as tool bodies.

As shown in FIG. 1A at reference 120, which illustrates a close-up view of the outer surface 130 of a blade 104, an array of blind apertures in the form of holes 122 have been formed in the blade outer surface (which presents the abrading or working surface of the tool), and these holes have been back-filled (i.e., plugged) with a super-abrasive material 124. The filled holes may likewise be provided on the surface of the gage pads 108.

Each hole 122 comprises a micro-hole having a diameter of about 1 mm to 3.5 mm and a depth of about 2 mm to 10 mm. The holes 122 are spaced from each other in the array by a distance of about two times the hole diameter to four times the hole diameter. The array of blind holes 122 preferably has a layout with a regular and repeating pattern, for example such as provided with a matrix format of columns and rows with a hole positioned at the intersection of each column and row (see, FIGS. 9A and 9B, for example). The blind holes may have any desired and suitable aspect ratio AR (i.e., ratio of hole depth d to hole diameter D, AR=d:D). Exemplary aspect ratios include about 2:1 to 5:1. It is preferred that the holes 122 have a depth sufficient to ensure availability of super-abrasive material 124 throughout the anticipated working life of the tool.

Figure 2:
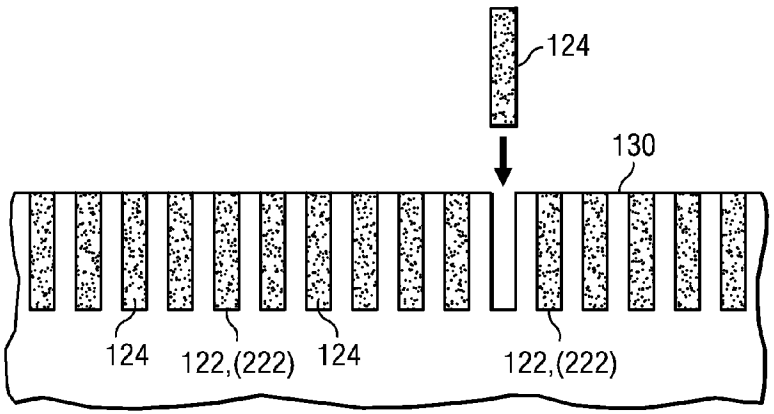
FIGS. 2 and 3 illustrate cross-sectional views of micro-holes plugged with super-abrasive material.

Reference is now made to FIG. 2 which illustrates a cross-section taken along lines 2-2 of FIG. 1A. FIG. 2 illustrates that the blind holes 122 are oriented substantially perpendicular to an outer surface 130 of the blade 104 or pad 108. Although the surface 130 is shown as flat in FIG. 2, it will be understood that this is due to the scale of the illustration relative to the outer surface of the blade 104 or pad 108. At this perspective, the surface 130 may be considered to be flat, but when taken with respect to the length of the blade 104 or pad 108, the outer surface is curved, and each blind hole 122 is locally oriented substantially perpendicular to the curved outer surface 130. Although the super-abrasive material 124 is shown flush with surface 130, it will be understood that this is by example only. Furthermore, although the super-abrasive material 124 is shown as single piece insert, it will be understood that multiple piece inserts could instead be used.

Figure 3:
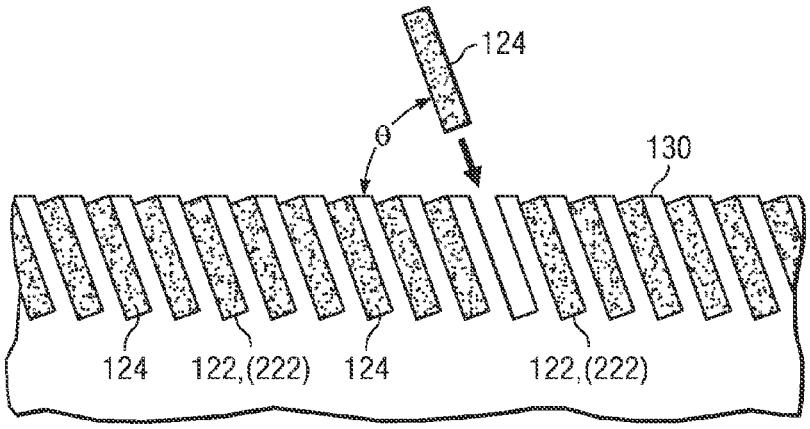

Reference is now made to FIG. 3 which illustrates a cross-section taken along lines 3-3 of FIG. 1A. FIG. 3 illustrates that the blind holes 122 are oriented substantially non-perpendicular to an outer surface 130 of the blade 104 or pad 108. Although the surface 130 is shown as flat in FIG. 3, it will be understood that this is due to the scale of the illustration relative to the surface of the blade 104 or pad 108. At this perspective, the surface 130 may be considered to be flat, but when taken with respect to the length of the blade 104 or pad 108, the outer surface is curved. Preferably, the orientation angle for the holes 122 in FIG. 3 is such that each hole points towards a direction of bit rotation. The advantage of this orientation is that it places the diamond material 124 filling the hole more in compressive stress and less in shear stress. Although the super-abrasive material 124 is shown substantially flush with surface 130, it will be understood that this is by example only. Furthermore, although the super-abrasive material 124 is shown as single piece insert, it will be understood that multiple piece inserts could instead be used.

With respect to FIGS. 2 and 3, it will be understood that the selection of a perpendicular or non-perpendicular orientation for the blind holes 122 may be region dependent. In other words, one region of the blade 104 or pad 108 may utilize holes with a perpendicular orientation while another region of the blade or pad may utilize holes with a non-perpendicular orientation. A gradual change in orientation angle for the holes 122 may also be provided with respect to the blade or pad (for example, changing along the length of the blade).

The angle θ for the non-perpendicular orientation of the blind holes 122 may also be region dependent. In other words, one region of the blade 104 or pad 108 may utilize holes with a first non-perpendicular orientation angle while another region of the blade or pad may utilize holes with a second non-perpendicular orientation angle. A gradual change in orientation angle for the holes 122 may also be provided with respect to the blade or pad (for example, changing along the length of the blade). It will also be understood that the angle θ may generally be representative of a compound angle.

FIGS. 2 and 3 are not intended to illustrate actual views, but rather are illustrative representations. The figures are not drawn to scale. Sizes, dimensions, thicknesses, and the like shown in the drawings may be exaggerated so as to more clearly illustrate the nature of the invention. Furthermore, although described in connection with a bit blade 104 or pad 108, it will be understood that the surface 130 could comprise any working surface of a tool, including the surface of a structure attached to a tool, as will be described below.

Figure 4:
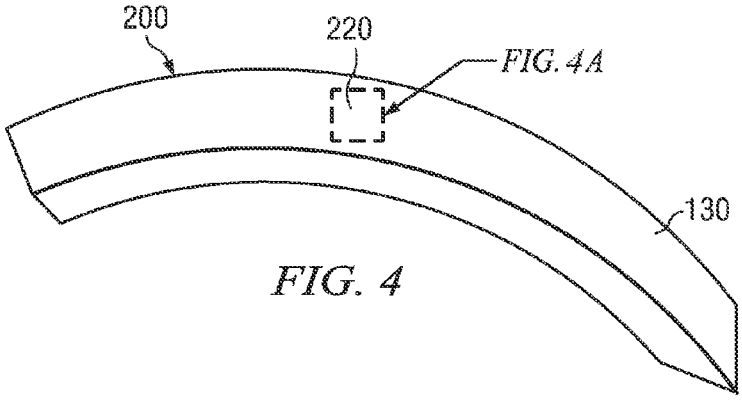
FIG. 4 illustrates a perspective view of a segment.

Reference is now made to FIG. 4 which illustrates a perspective view of a segment 200. The segment 200 is shown to have a spiral shape, but it will be understood that the segment could alternatively be configured with a straight shape. The thickness of the segment 200 may be substantially constant along the segment length, or alternatively have a changing thickness. The width of the segment 200 may be substantially constant along the segment length, or alternatively have a changing width. The thickness and width characteristics, as well as the selection of a spiral or straight configuration, are a matter of design.

In prior art diamond-impregnated segments, the segment 200 would be made, for example, of fused tungsten carbide which impregnates randomly distributed diamond. In a typical application, such segments would be attached to the outer surface of a bit body (for example, with a brazing process). In some implementations, such segments would form all or a part of a blade structure for the tool.

In FIG. 4, the segments 200 are made preferably, but not necessarily, made of tungsten carbide. In other applications, the material may comprise hardened steel. In still other applications, the material may comprise materials known to those skilled in the art for use as tool bodies.

Figure 4A:
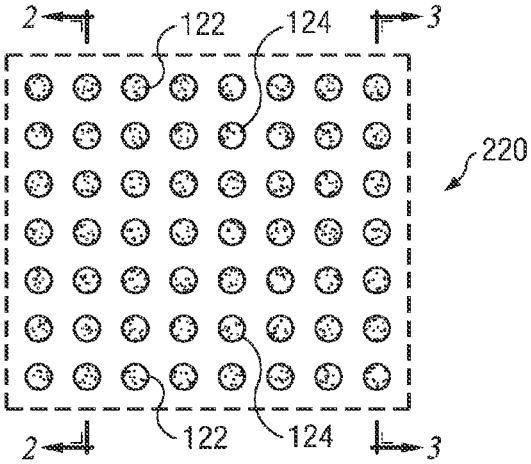
FIG. 4A illustrates a close-up view of a portion of the surface of the segment in FIG. 4.

As shown in FIG. 4A at reference 220, which illustrates a close-up view of the outer surface 130 of the segment 200 (which will form an abrading or working surface), an array of blind apertures in the form of holes 122 have been formed in the segment outer surface, and these holes have been back-filled (i.e., plugged) with a super-abrasive material 124.

Each hole 122 comprises a micro-hole having a diameter of about 1 mm to 3.5 mm and a depth of about 2 mm to 10 mm. The holes 122 are spaced from each other in the array by a distance of about two times the hole diameter to four times the hole diameter. The array of blind holes 122 preferably has a layout with a regular and repeating pattern, for example such as provided with a matrix format of columns and rows with a hole positioned at the intersection of each column and row. The blind holes may have any desired and suitable aspect ratio AR (i.e., ratio of hole depth d to hole diameter D, AR=d:D). Exemplary aspect ratios include about 2:1 to 5:1. It is preferred that the holes 122 have a depth sufficient to ensure availability of super-abrasive material 124 throughout the anticipated working life of the tool.

FIG. 2, described previously, illustrates a cross-section taken along lines 2-2 of FIG. 4A with perpendicularly oriented holes 122 (i.e., holes oriented perpendicular to the outer abrading or working surface 130 of the segment 200). FIG. 3, described previously, illustrates a cross-section taken along lines 3-3 of FIG. 4A with non-perpendicularly oriented holes 122 (i.e., holes oriented non-perpendicular to the outer abrading or working surface 130 of the segment 200).

Figure 5:
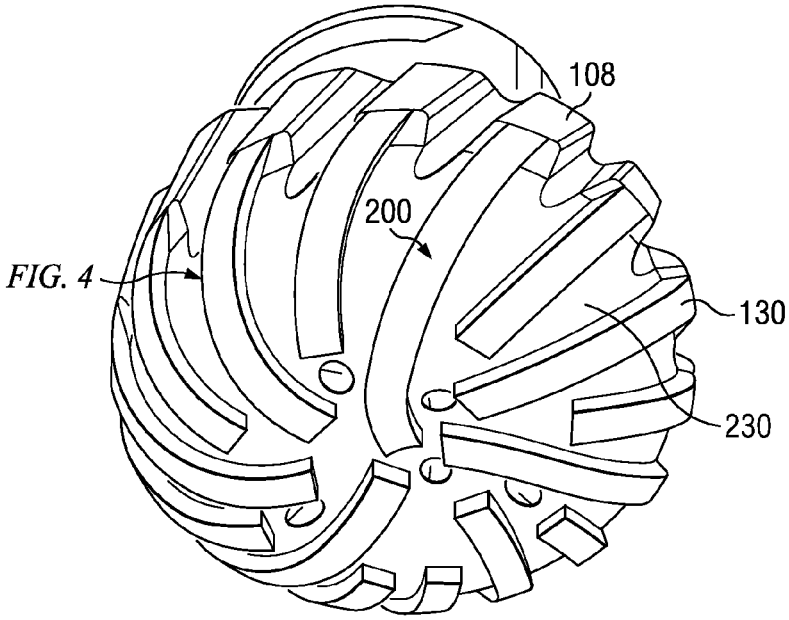
FIG. 5 illustrates use of the segment of FIG. 4 as a blade structure for a drill bit.

Reference is now made to FIG. 5 which illustrates use of the segment 200 of FIG. 4 as a blade structure for a drill bit. In this implementation, a plurality of segments 200 fabricated in the manner shown in FIGS. 2, 3 and 4 with specific geometric characteristics are mounted to an outer surface 230 of a drill bit body and extend at the least over a crown region of the tool. The segments 200 may be attached to the body of the drill bit using brazing or furnacing techniques known to those skilled in the art. The depth of the segments 200, along with the spacing between installed segments, is designed to provide channels (also referred to as junk slots) that permit the return flow of drilling cuttings and drilling fluid.

The drill bit of FIG. 5 further includes a gage pad 108 associated with each blade. The gage pads 108 are typically formed as an integral part of the bit body, and may include the array of blind holes 122 back-filled with diamond material 124 (as indicated at reference 220 in FIG. 4A and reference 120 in FIG. 1A). Alternatively, the gage pads 108 may comprise a separate segment 200 like that shown in FIG. 4 that is attached to the outer surface 230 of the drill bit body in the gage region. Still further, it will be understood that the segment 200 shown in FIG. 4 may be designed with a geometry to include the gage pad 108, with the segment attached to the outer surface 230 of the drill bit body and extending from the crown region to the gage region of the tool.

Figure 6:
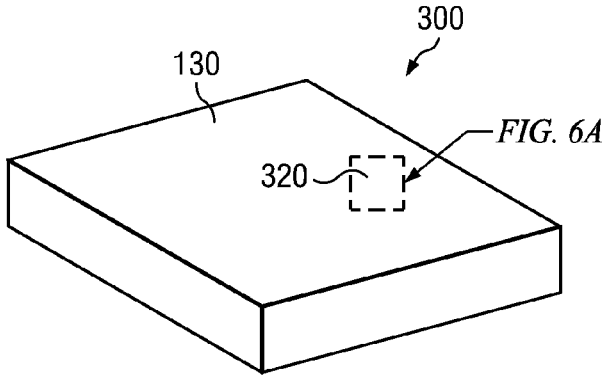
FIG. 6 illustrates a perspective view of a construct.

Reference is now made to FIG. 6 which illustrates a perspective view of a construct 300. The construct 300 is generically shown to have a rectangular block shape, but it will be understood that the construct could alternatively be configured with any desired shape and having any desired thickness, width and length as a matter of design and application of the construct in a working tool. The construct 300 is made, for example, of fused tungsten carbide or hardened steel. In still other applications, the material may comprise materials known to those skilled in the art for use as tool bodies.

Figure 6A:
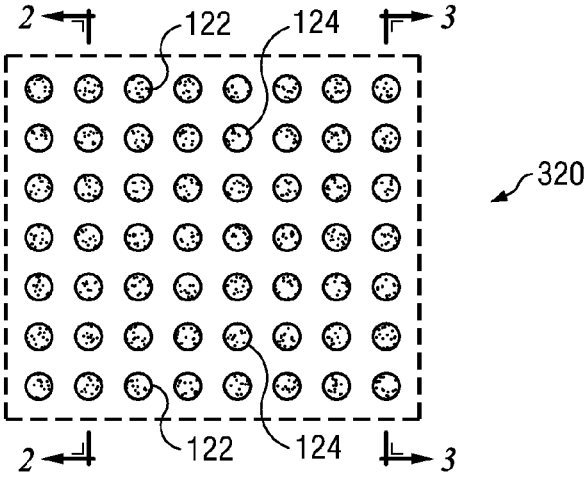
FIG. 6A illustrates a close-up view of a portion of the surface of the construct in FIG. 6.

As shown in FIG. 6A at reference 320, which illustrates a close-up view of the outer surface 130 of the construct 300, an array of blind apertures in the form of holes 122 have been formed in the construct outer surface, and these holes have been back-filled (i.e., plugged) with a super-abrasive material 124.

Each hole 122 comprises a micro-hole having a diameter of about 1 mm to 3.5 mm and a depth of about 2 mm to 10 mm. The holes 122 are spaced from each other in the array by a distance of about two times the hole diameter to four times the hole diameter. The array of blind holes 122 preferably has a layout with a regular and repeating pattern, for example such as provided with a matrix format of columns and rows with a hole positioned at the intersection of each column and row. The blind holes may have any desired and suitable aspect ratio AR (i.e., ratio of hole depth d to hole diameter D, AR=d:D). Exemplary aspect ratios include about 2:1 to 5:1. It is preferred that the holes 122 have a depth sufficient to ensure availability of super-abrasive material 124 throughout the anticipated working life of the tool.

FIG. 2, described previously, illustrates a cross-section taken along lines 2-2 of FIG. 6A with perpendicularly oriented holes 122 (i.e., holes oriented perpendicular to the outer abrading or working surface 130 of the construct 300). FIG. 3, described previously, illustrates a cross-section taken along lines 3-3 of FIG. 6A with non-perpendicularly oriented holes 122 (i.e., holes oriented non-perpendicular to the outer abrading or working surface 130 of the construct 300).

The construct 300 may be used as an abrading, cutting or machining structure. In such applications, the construct 300 may be attached to a supporting substrate to produce a working tool, or otherwise integrally formed as the tool itself. The construct 300 may be attached to substrate using brazing or furnacing techniques known to those skilled in the art. It will be understood that the fabricated construct 300 could be used in any cutting or abrading tool including, without limitation, grinders, dressing tools, saw blade, wire saws, and the like.

For each of the embodiments described above in FIGS. 1-6, the super-abrasive material 124 used to plug each hole 122 may have any of a number of forms known to those skilled in the art. One example of a super-abrasive material is a polycrystalline diamond compact (PDC) rod (for example of a solid cylindrical configuration) that is sized and shaped to fit the hole opening. PDC components of this type are available from a number of sources known in the art, and may be fully or partially leached as desired. Another example of a super-abrasive material is a cubic boron nitride (CBN) rod that is sized and shaped to fit the hole opening. CBN components of this type are available from a number of sources known in the art. Another example of a super-abrasive material is a diamond impregnated construct rod that is sized and shaped to fit the hole opening. The diamond impregnated construct rod is fabricated in a manner well known to those skilled in the art by impregnating diamond within a fused tungsten carbide matrix. Another example of a super-abrasive material is a thermally stable polycrystalline diamond rod that is sized and shaped to fit the hole opening. TSP components of this type are available from a number of sources known in the art. The holes 122 may have a round cylindrical configuration, and the super-abrasive material 124 rod may have a corresponding round cylindrical configuration. The super-abrasive material 124 rod may be secured within each opening using any suitable means including: brazing, interference fit, press-fit, friction-fit or adhesive.

With respect to the super-abrasive material 124 used to plug the blind holes 122, it will be understood that the super-abrasive material 124 may exhibit variation in characteristic as a function of depth. In other words, the material and/or functional characteristics of the super-abrasive material 124 plug may vary depending on plug depth. In an embodiment, one or more of super-abrasive particle distribution, super-abrasive particle content, and powder matrix component distribution may vary as a function of depth. These variations may be tailored to suit a particular working application of the tool (for example, having the tool start with a "softer" grade and finish with a "harder" grade). As an example, the diamond distribution may vary as a function of depth with respect to random and/or non-random diamond distributions. As an example, diamond content may vary as a function of depth with respect to diamond size and/or diamond volume. As an example, powder matrix component distribution may vary, such as with a tungsten carbide matrix, with respect to relative tungsten versus carbide richness.

It is preferred that the operation used for plugging each hole 122 with super-abrasive material 124 be a "cold" process. In other words, the plugging process should not require the application of excessive heat. The goal with the "cold" process is to ensure that each hole 122 is plugged with super-abrasive material 124 in a way that excessive heating of the included diamond, which may result in graphitization, does not occur. Pressing, low-temperature brazing and electroplating comprise suitable options for the plugging process.

Although FIGS. 1, 4 and 6 illustrate the use of apertures in the form of round holes 122, it will be understood that the apertures could include openings having other shapes. For example, instead of a hole with a round cross-section, the hole could instead have a square cross-section.

Figure 7:
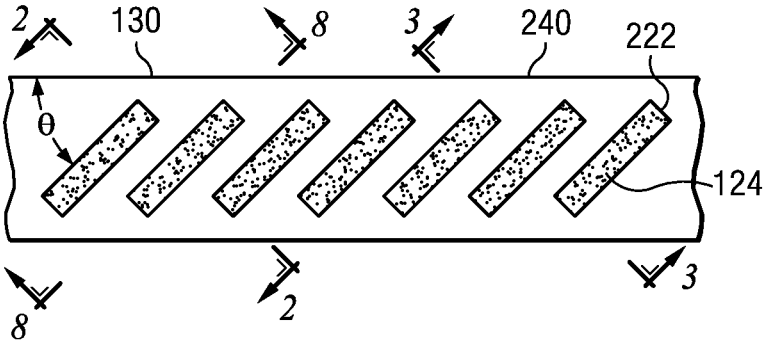
FIG. 7 a plan view for an array of blind slots plugged with super-abrasive material.

With reference to FIG. 7, the array of blind apertures are provided in the form of a plurality of slots 222 formed in an outer surface 130 of a structure such as a blade (FIG. 1), segment (FIG. 4) or construct (FIG. 6) that presents the abrading or working surface of the tool. The slots 222 are back-filled (i.e., plugged) with a super-abrasive material 124.

Each slot 222 has a width of about 1 mm to 4 mm, a length of about 5 mm-15 mm, and a depth of about 2 mm to 15 mm. The slots 222 are spaced from each other in the array by a distance of about two times the sloth width to four times the slot width. The array of blind slots 222 preferably has a layout with a regular and repeating pattern, for example such as provided with a matrix format of columns and rows, with the slots oriented parallel to each other. It is preferred that the slots 222 have a depth sufficient to ensure availability of super-abrasive material 124 throughout the anticipated working life of the tool.

FIG. 7 further shows an edge 240 and an orientation of the plurality of slots 222 relative to that edge 240. The edge 240 is an edge of the supporting structure and may comprise, for example, the leading edge of a blade or segment (like those shown in FIGS. 1 and 4). The slots 22 are oriented at an angle θ (not necessarily the same θ as in FIG. 3) relative to the edge 240, with a direction perpendicular to the edge 240 being generally indicative of the orientation with which the cutting or abrading operation is performed (i.e., the orientation for attacking the target material). The angle θ is preferably between zero and forty-five degrees.

Figure 8:
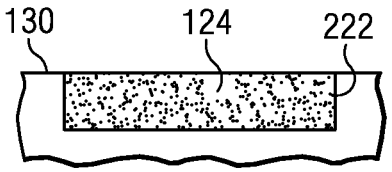
FIG. 8 is a cross-sectional views of a slot plugged with super-abrasive material.

Reference is now made to FIG. 8 which illustrates a cross-section taken along lines 8-8 of FIG. 7. Although the surface 130 is shown as flat in FIG. 8, it will be understood that this is due to the scale of the illustration relative to the outer surface of the supporting structure. At this perspective, the surface 130 may be considered to be flat, but when taken with respect to the length of the supporting structure, the outer surface is curved. FIG. 2, described previously, illustrates a cross-section taken along lines 2-2 of FIG. 7 with perpendicularly oriented slots 222 (i.e., slots oriented perpendicular to the outer abrading or working surface 130). FIG. 3, described previously, illustrates a cross-section taken along lines 3-3 of FIG. 7 with non-perpendicularly oriented slots 222 (i.e., slots oriented non-perpendicular to the outer abrading or working surface 130).

The super-abrasive material 124 used to plug each slot 222 may have any of a number of forms known to those skilled in the art. One example of a super-abrasive material is a polycrystalline diamond compact (PDC) slab that is sized and shaped to fit the slot opening. PDC components of this type are available from a number of sources known in the art, and may be fully or partially leached as desired. Another example of a super-abrasive material is a cubic boron nitride (CBN) slab that is sized and shaped to fit the slot opening. CBN components of this type are available from a number of sources known in the art. Another example of a super-abrasive material is a diamond impregnated construct slab that is sized and shaped to fit the slot opening. The diamond impregnated construct slab is fabricated in a manner well known to those skilled in the art by impregnating diamond within a fused tungsten carbide matrix. Another example of a super-abrasive material is a thermally stable polycrystalline diamond slab that is sized and shaped to fit the slot opening. TSP components of this type are available from a number of sources known in the art. The slots 222 preferably have a rectangular cross-section, and the super-abrasive material 124 slab has a corresponding rectangular cross-section configuration. The super-abrasive material 124 slab may be secured within each opening using any suitable means including: brazing, interference fit, press-fit, friction-fit or adhesive.

With respect to the super-abrasive material 124 used to plug the blind slots 222, it will be understood that the super-abrasive material 124 may exhibit variation in characteristic as a function of depth. In other words, the material and/or functional characteristics of the super-abrasive material 124 plug may vary depending on plug depth. In an embodiment, one or more of super-abrasive particle distribution, super-abrasive particle content, and powder matrix component distribution may vary as a function of depth. These variations may be tailored to suit a particular working application of the tool (for example, having the tool start with a "softer" grade and finish with a "harder" grade). As an example, the diamond distribution may vary as a function of depth with respect to random and/or non-random diamond distributions. As an example, diamond content may vary as a function of depth with respect to diamond size and/or diamond volume. As an example, powder matrix component distribution may vary, such as with a tungsten carbide matrix, with respect to relative tungsten versus carbide richness.

It is preferred that the operation used for plugging each slot 222 with super-abrasive material 124 be a "cold" process. In other words, the plugging process should not require the application of excessive heat. The goal with the "cold" process is to ensure that each slot 222 is plugged with super-abrasive material 124 in a way that excessive heating of the included diamond, which may result in graphitization, does not occur. Pressing, low-temperature brazing and electroplating comprise suitable options for the plugging process.

Figure 9A:
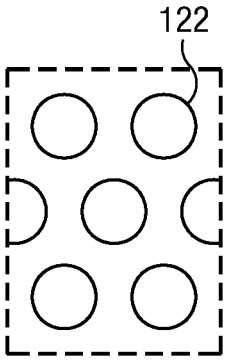
FIGS. 9A and 9B illustrate examples of a regular and repeating layout of micro-holes.
Figure 9B:
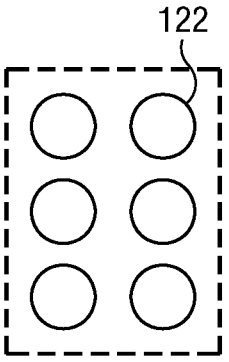

Reference is now made to FIGS. 9A and 9B which illustrate examples of a regular and repeating layout of holes 122 in the form of two exemplary arrays. The illustrations in FIGS. 9A and 9B are plan views. It will be understood that the layouts of FIGS. 9A and 9B are exemplary only, and that other regular and repeating patterns could alternatively be chosen. It will further be understood that the geometric precision of the regular and repeating layout of holes 122 shown in FIGS. 9A and 9B is not a requirement. Rather, the holes 122 should be laid out in a manner as closely approaching the illustrated geometric precision as is possible. Slight variations in position of the holes are acceptable. FIG. 7 illustrates an example of a regular and repeating layout of slots 222. Although only one row of slots 222 is shown, it will be understood that the slots 222 could be arranged, like the holes 122, in a matrix array with multiple rows and columns.

The holes 122 and slots 222 preferably comprise micro-apertures produced, for example, using a micro-drilling process. An exemplary micro-drilling process comprises electrical discharge machining (EDM) which is a contactless machining process. During EDM, sparks form in a dielectric as a result of an electrical discharge between a tool electrode and a conductive work piece. The sparks erode or remove materials from the surface of the work piece by heating, melting and vaporizing the material. Repeated action produces an aperture in the work piece having a well-controlled set of dimensions (diameter and depth for a hole 122; and width, length and depth for a slot 222). Advantages of the use of EDM for micro-aperture formation include: a burr-free sidewall, aspect ratios as high as 10:1; consistent cross-sectional dimensions over aperture depth; support of a wide range of surface dimensions ranging from 5-300 microns; ability to produce apertures on an angled or curved surface; straightness of the apertures; computerized control for replicatable aperture dimensions and relationships (for example, hole diameter, hole depth and inter-hole spacing) over a plurality of drilled apertures and for an array of apertures; and ability to economically and accurately drill apertures in hardened steel or carbide materials.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. Apparatus, comprising:

a substrate having a surface;

a plurality of blind apertures formed in said surface, wherein each blind aperture of the plurality of blind apertures has a slot-shaped opening with a cross-sectional dimension in the range of 1 mm to 15 mm, the cross-sectional dimension being a width of the opening, the slot-shaped opening oriented non-perpendicular to an edge of the substrate, a longitudinal axis of the each blind aperture defining an angle greater zero with respect to the surface of the substrate, the angle varying along a length of the substrate; and an elongated insert of super-abrasive material press-fit to fill the each blind aperture of the plurality of blind apertures.

2. The apparatus of claim 1, wherein the each blind aperture in the plurality of blind apertures has a depth in the range of 2 mm to 15 mm.

3. The apparatus of claim 1, wherein the each blind aperture of the plurality of blind apertures has an aspect ratio in the range of 2:1 to 5:1.

4. The apparatus of claim 1, wherein adjacent blind apertures of the plurality of blind apertures are separated from each other by a distance in the range of two times the cross-sectional dimension to four times the cross-sectional dimension.

5. The apparatus of claim 1, wherein the elongated insert is a formed of super-abrasive particles selected from the group consisting of: diamond particles, thermally stable polycrystalline diamond particles, and cubic boron nitride particles.

6. The apparatus of claim 1, wherein the plurality of blind apertures formed in said surface are arranged in a regular and repeating pattern.

7. The apparatus of claim 1, wherein the plurality of blind apertures formed in said surface are arranged in an array.

8. The apparatus of claim 1, wherein the substrate is made of hardened steel.

9. The apparatus of claim 1, wherein the substrate is made of tungsten carbide.

10. The apparatus of claim 1, wherein the super-abrasive material comprises a polycrystalline diamond compact.

11. The apparatus of claim 1, wherein the super-abrasive material comprises an impregnated diamond material.

12. The apparatus of claim 11, wherein the impregnated diamond material comprises fused tungsten carbide impregnating randomly distributed diamond particles.

13. The apparatus of claim 1, the slot-shaped opening has a rectangular cross-section, the width of 1 mm to 4 mm, a length of 5 mm to 15 mm and a depth of 2 mm-15 mm.

14. The apparatus of claim 1, wherein the surface of the substrate including the filled blind apertures is a working surface of a tool.

15. The apparatus of claim 14, wherein the tool is a drill bit.

16. The apparatus of claim 1, wherein the substrate including the filled blind apertures comprises a tool segment, the apparatus further comprising a tool body, where the tool segment is attached to an outer surface of the tool body.

17. The apparatus of claim 16, wherein the tool segment comprises a blade structure attached to the outer surface of the tool body.

18. The apparatus of claim 16, wherein the tool segment comprises a gage pad structure attached to the outer surface of the tool body.

19. The apparatus of claim 1, wherein the plurality of blind apertures comprises electrical discharge machined apertures.

20. The apparatus of claim 1, wherein the super-abrasive material exhibits variation in characteristic as a function of depth.

21. The apparatus of claim 20, wherein the variation in characteristic is selected from the group of characteristics consisting of diamond distribution, diamond content, and powder matrix component distribution.

22. The apparatus of claim 1, wherein the plurality of blind apertures are disposed in a matrix having three or more rows and three or more columns.

23. An earth boring tool, comprising:

a tool body;

at least one blade supported by the tool body;

a plurality of blind micro-apertures arranged in an array and formed in a working surface of the blade, the array being a matrix having three or more rows and three or more columns, each blind micro-aperture of the plurality of blind micro-apertures having a slot-shaped cross section oriented non-perpendicular to an edge of the blade and the each blind micro-aperture having a longitudinal axis at an angle greater than zero with respect to the surface of the blade, the angle varying along a length of the blade; and a super-abrasive surface formed by filling the each blind micro-aperture with an elongated insert of super-abrasive material, the super-abrasive surface substantially covering the working surface of the blade.

24. The earth boring tool of claim 23, wherein the super-abrasive material is press-fit in the each blind micro-aperture.

25. The earth boring tool of claim 23, wherein the elongated insert is a rod formed of super-abrasive particles selected from the group consisting of: diamond particles, thermally stable polycrystalline diamond particles, and cubic boron nitride particles.

* * * * *

UNITED STATES PATENT AND TRADEMARK OFFICE

CERTIFICATE OF CORRECTION

PATENT NO. : 9,162,345 B2
APPLICATION NO. : 13/491798
DATED : October 20, 2015
INVENTOR(S) : Michel De Reynal It is certified that error appears in the above-identified patent and that said Letters Patent is hereby corrected as shown below:

In the Claims:

At column 9, claim number 1, line number 54, delete the words “greater zero”.

At column 10, claim number 13, line number 24, insert the word -- wherein -- before the phrase “the slot-shaped”.

At column 11, claim number 25, line number 6, delete the words “a rod”.

Signed and Sealed this
Seventeenth Day of May, 2016

Michelle K. Lee

Michelle K. Lee
*Director of the United States Patent and Trademark Office*